US012497883B2

(12) United States Patent
Aleid

(10) Patent No.: US 12,497,883 B2
(45) Date of Patent: Dec. 16, 2025

(54) INCREASING HYDROCARBON RECOVERY IN A MULTIPURPOSE WELL

(71) Applicant: Saudi Arabian Oil Company, Dhahran (SA)

(72) Inventor: Abdulrahman K. Aleid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/502,794

(22) Filed: Nov. 6, 2023

(65) Prior Publication Data

US 2025/0146398 A1 May 8, 2025

(51) Int. Cl.
*E21B 43/38* (2006.01)
*E21B 43/12* (2006.01)

(52) U.S. Cl.
CPC ..... *E21B 43/385* (2013.01); *E21B 43/128* (2013.01)

(58) Field of Classification Search
CPC ..... E21B 43/38; E21B 43/358
See application file for complete search history.

(56) References Cited

U.S. PATENT DOCUMENTS

| | | | | |
|---|---|---|---|---|
| 5,857,519 | A | 1/1999 | Bowlin et al. | |
| 5,913,363 | A | 6/1999 | Paplinski | |
| 6,138,758 | A | 10/2000 | Shaw et al. | |
| 6,336,503 | B1 * | 1/2002 | Alhanati | E21B 43/385 166/313 |
| 6,547,003 | B1 * | 4/2003 | Bangash | E21B 43/40 166/66.4 |
| 6,550,535 | B1 | 4/2003 | Traylor | |
| 6,691,781 | B2 | 2/2004 | Grant et al. | |
| 6,845,821 | B2 | 1/2005 | Bouma et al. | |
| 7,607,479 | B2 | 10/2009 | Cognata | |
| 7,621,339 | B2 | 11/2009 | Johnson et al. | |
| 8,505,627 | B2 | 8/2013 | Cox | |
| 8,616,272 | B2 | 12/2013 | Mazyar et al. | |
| 8,757,256 | B2 | 6/2014 | Li et al. | |
| 10,053,970 | B2 | 8/2018 | Ramsey et al. | |
| 10,174,597 | B2 | 1/2019 | Looijer et al. | |
| 10,502,031 | B2 | 12/2019 | Winters | |
| 10,844,700 | B2 | 11/2020 | Al-Gouhi | |
| 11,053,788 | B2 | 7/2021 | Abdel-Fattah et al. | |

(Continued)

FOREIGN PATENT DOCUMENTS

| | | |
|---|---|---|
| AU | 2010216407 | 11/2014 |
| EP | 0963505 | 11/2002 |

(Continued)

*Primary Examiner* — David Carroll
(74) *Attorney, Agent, or Firm* — Fish & Richardson P.C.

(57) ABSTRACT

Systems and methods for downhole separation of water from hydrocarbons in a wellbore can include a first seal limiting flow of fluids downhole in the wellbore and a second seal limiting flow of fluids uphole in the wellbore. A hydrocarbon separator is positioned to receive fluids present in the wellbore between the first seal and the second seal and discharge hydrocarbons into the wellbore uphole of the second seal. A liquid collection vessel receives water discharged by the hydrocarbon separator. A conduit extends downhole from the liquid collection vessel through the first seal and the second seal. A pump installed with the conduit is operable to pump fluids from liquid collection vessel downhole and out of the wellbore.

18 Claims, 3 Drawing Sheets

(56) References Cited

U.S. PATENT DOCUMENTS

| | | | | |
|---|---|---|---|---|
| 11,098,547 | B2 | 8/2021 | Amoudi et al. | |
| 11,136,875 | B2 | 10/2021 | Ayub | |
| 11,180,980 | B2 | 11/2021 | Wang et al. | |
| 11,255,128 | B2 | 2/2022 | Alharbi et al. | |
| 11,428,049 | B2 | 8/2022 | Sehsah et al. | |
| 11,599,955 | B2 | 3/2023 | Aleid et al. | |
| 12,012,810 | B2 | 6/2024 | Aleid | |
| 2011/0079388 | A1* | 4/2011 | Cox | E21B 43/38 166/266 |
| 2017/0022797 | A1* | 1/2017 | Joshi | E21B 43/385 |
| 2020/0217187 | A1* | 7/2020 | Wang | E21B 43/35 |
| 2022/0090467 | A1* | 3/2022 | Manning | E21B 34/101 |
| 2022/0403726 | A1* | 12/2022 | Al-Qasim | E21B 43/40 |
| 2023/0392458 | A1 | 12/2023 | Aleid | |

FOREIGN PATENT DOCUMENTS

| | | |
|---|---|---|
| EP | 1266122 | 5/2006 |
| EP | 3097261 | 5/2021 |

* cited by examiner

INCREASING HYDROCARBON RECOVERY IN A MULTIPURPOSE WELL

TECHNICAL FIELD

The present disclosure generally relates to hydrocarbon production, in particular hydrocarbon production from a multipurpose well.

BACKGROUND

Waste water production with oil and gas is a challenge for the oil and natural gas industry. During the production of oil and natural gas, the oil and natural gas sometimes also includes water. The water produced through wells can originate from the hydrocarbon bearing zones, from aquifers that are near the hydrocarbon bearing zones, or from water that is injected downhole. Various chemicals are sometimes also mixed with the injection water to improve the reservoir sweep efficiency. When produced at the surface, this mixture of water and at least one of oil or gas can create a concern from an environmental standpoint.

Sources of water can be wells having a completion depth close to the water zone, high permeability paths from the aquifer to the well trajectory, and high reservoir pressure drawdown accelerating the water cones to develop quickly towards the producer's lateral(s).

SUMMARY

This specification describes an approach to separating hydrocarbons from water downhole and producing the hydrocarbons to the surface while injecting the water back into the formation. In particular, this approach uses a downhole separation mechanism for water to allow the gas/oil travel up while reinjecting the separated water back to the aquifer through a predesigned downhole path equipped with a water pump. The associated systems and methods can allow the hydrocarbons to flow naturally to the surface or, as may be needed in mature fields, include pumps or compressors to produce the hydrocarbons to the surface.

Implementations of the systems and methods described in this specification can provide one or more of the following advantages.

The downhole separation of water from production fluids and injection of water back into the formation provides significant advantages. The production fluids are often a mixture of gas, oil and water. In the case of an oil well, the operating pressure downhole can be below the bubble point pressure or the well can have gas produced from the gas cap together with the oil. For gas wells, the gas is often produced with condensate and water.

This approach can reduce capital expenditures by using a single well as a producer and disposal/injector without requiring sidetracking. The savings can be significant as some estimates indicate that the sidetracking required by other approaches cost an average of $3,000,000 USD.

It can also reduce operating expenses since the produced water is directly disposed instead of handling at the surface thus avoiding the costs associated with producing water to surface, treating it, and drilling a new well, and disposing of the water.

This approach can also enhance production. For example, downhole fluid separation can lead to recovering dry gas rather than wet gas. In addition, injecting separated water back into the formation below the hydrocarbons being produced can also act as a water injection well helping lift and/or mobilize the hydrocarbons being produced.

The associated systems and methods can also be used in reviving dead wells by addressing low/moderate water cut and high surface back pressure.

The details of one or more embodiments of these systems and methods are set forth in the accompanying drawings and the description to be presented. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

This specification describes an approach to separating hydrocarbons from water downhole and producing the hydrocarbons to the surface while injecting the water back into the formation. In particular, this approach uses a downhole separation mechanism for water to allow the gas/oil travel up while reinjecting the separated water back to the aquifer through a predesigned downhole path equipped with a water pump. The associated systems and methods can allow the hydrocarbons to flow naturally to the surface or, as may be needed in mature fields, include pumps or compressors to produce the hydrocarbons to the surface.

Figure 1:
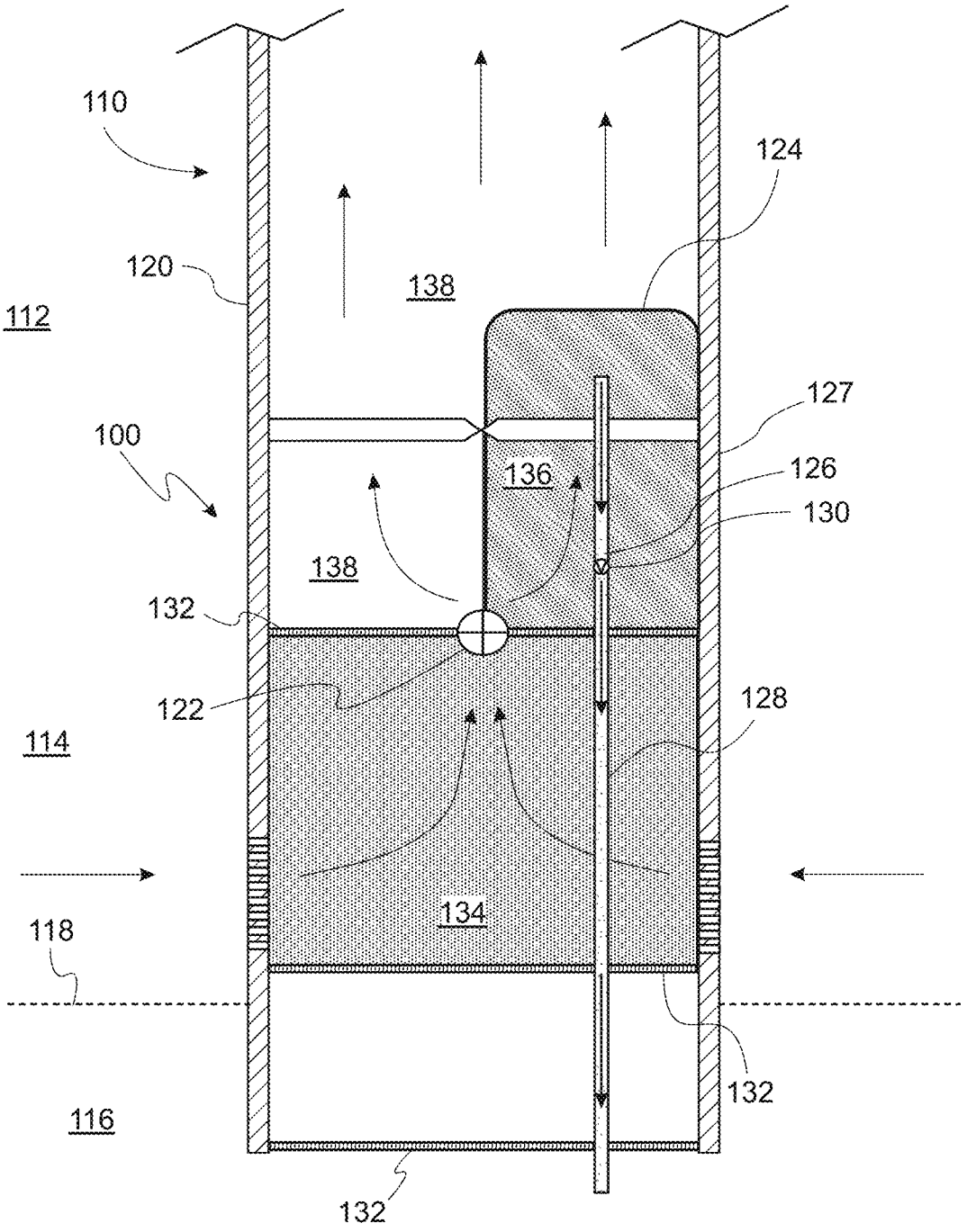
FIG. 1 is a schematic illustrating operation of a downhole separation device.

FIG. 1 is a schematic illustrating operation of a downhole separation system 100 installed in a well 110 extending into a subsurface formation 112. The subsurface formation 112 has a gas zone 114 and a water zone 116 meeting at a gas-water contact line 118. The downhole separation system 100 is primarily intended to be used in locations including the water zone 116 is present under the gas zone 114. In such locations, disposal of the separated water in the underlying water zone 116 tends to enhance production from the well 110. A casing 120 of the well 110 into or near the water zone 116 and helps provide a route for disposal of the separated water.

The system 100 is installed in the casing 120 of the well. The system 100 includes a liquid-gas separator 122, a liquid collection vessel 124, an intelligent valve system 126, separation chambers 127, separated water tubing 128, and a pump 130. The casing 120 and seals 132 (e.g., packers or plugs) extending across the borehole cooperate with the system 100 to define the flowpaths through which fluids flow.

The liquid-gas separator 122 separates a multiphase produced fluid 134 into a liquid-dominated stream 136 (e.g., a stream having a gas volume fraction (GVF)<5%) and a gas-dominated stream 138 (e.g., a stream having a GVF>95%). The liquid-gas separator 122 can implement gravity, shrouds, or cylindrical cyclonic separation techniques.

The gas-dominated stream 138 flows to the surface and the liquid-dominated stream 136 is routed into the liquid collection vessel 124. The liquid collection vessel 124 functions to capture the liquid in preparation to pumping it down into the formation. The intelligent valve system 126 is operated based on water saturation. The valve system opens (e.g., between 98% and 100% water saturation) and the pump 130 is activated to begin injecting water into the water zone 116 of the subsurface formation 112. When the water saturation drops below a specified value (e.g., is less than 95%), the system unloads and lowers the pressure at the bottom of the active reservoir. This allows for better separation and also protects the pump 130 (e.g. from vapor lock).

The separated water tubing 128 extends downhole from the liquid collection vessel through the casing 120 to the water zone 116 of the subsurface formation 112. The portion of the well 10 in which the separated water tubing 128 runs within the casing 120 is sometimes referred to as the "dual tubing" portion of the well 110. Typically, another seal 132 is installed at the bottom of the casing 120 and/or the casing is cemented around the separated water tubing 128. The separated water tubing 128 extends past the bottom seal and/or cement to discharge in the water zone 116.

The pump 130 is installed in the separated water tubing 128. The separated water tubing 128 is typically a non-metallic tubing which provides corrosion resistance], but in some implementations is a metallic pipe. The pump 130 is typically an inverted electrical submersible pump, but in some implementations is a regular downhole pump.

Although discussed in the context of separating water and gas, a similar approach can be used to separate produced water from oil. In implementations for this application, the liquid-gas separator of the system 100 is replaced by an oil-water separator. Some implementations includes a liquid-gas separation system in series with an oil-water separation system for a field in which the produced fluids contained water, oil, and gas?

The system 100 is illustrated with the gas flowing naturally to the surface without artificial lift systems. However, implementations in mature fields may include compressors (e.g., for gas fields) or pumps (e.g., for oilfields) to produce the hydrocarbons to the surface.

Figure 2:
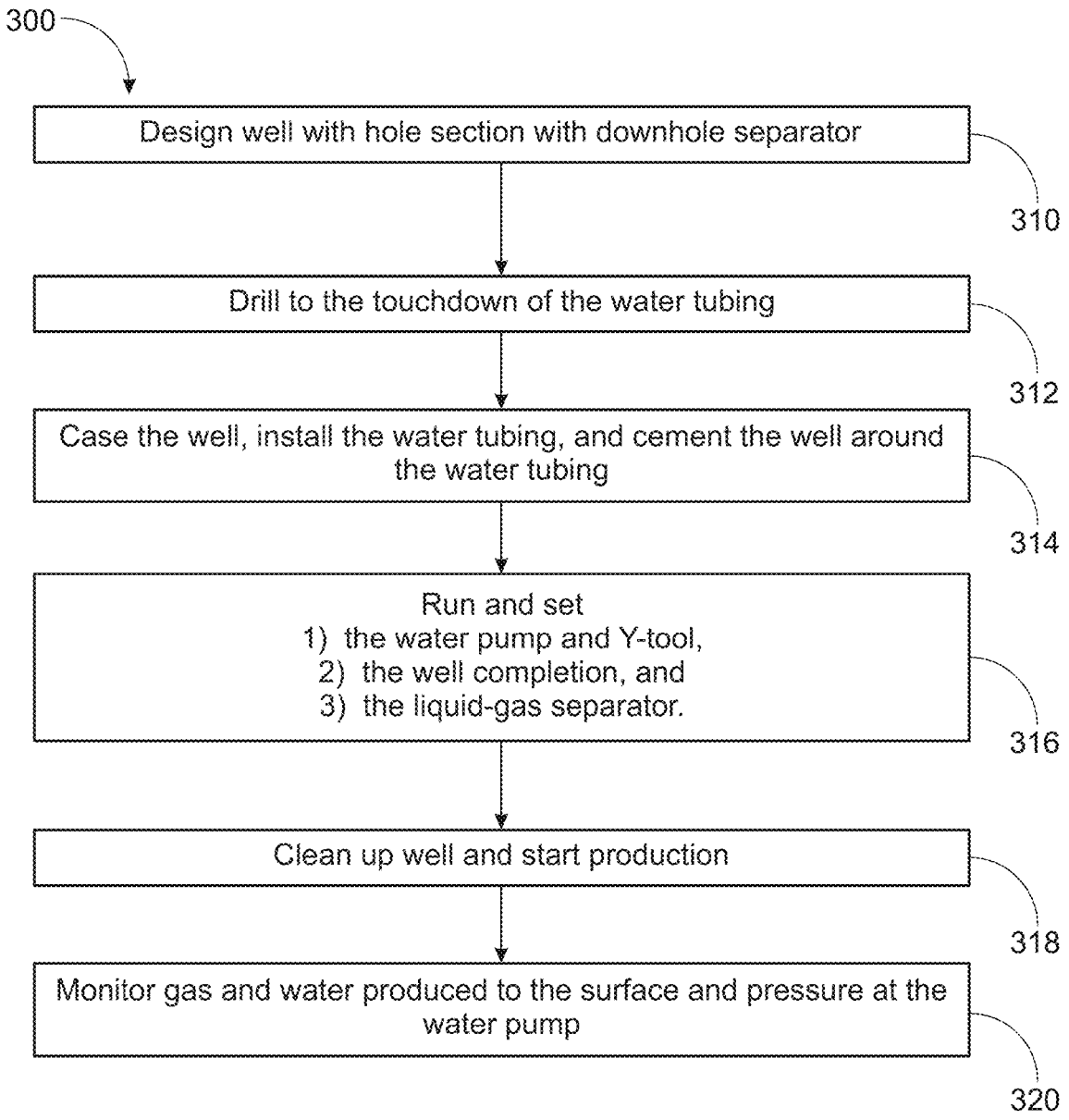
FIG. 2 is a flow chart of a method for installing and operating a downhole separation device in a new well.

FIG. 2 is a flow chart of a method 300 for installing and operating a downhole separation system (e.g., the system 100) in a new well. The method 300 will typically be implemented when there is a high water cut ratio (i.e., percentage of the water v. hydrocarbons)]. In these situations, the well will be designed with a hole section to be fitted with dual tubing completion (step 310). The design will include identifying the top end (TE) and touchdown (TD) of the water tubing and will consider downhole pressure, productivity, and quality of fluid produced (water v. hydrocarbons).

The well will then be drilled to the touchdown of the water tubing (step 312) following the recommended drilling practices for the selected location. The wellbore will be cased, the water tubing be installed, and the well will be cemented around the water tubing (step 314). After cementing, the water pump will be run and set. Typically, a Y-tool will be run in with the water pump to provide access if needed and to perform the setting. The well completion and the liquid-gas separator are then run and set (step 316). They may be set mechanically, hydraulically, or using expandable elements. The isolation packers will then be set before the well is cleaned up and production started (step 318).

During production, operators will monitor gas and water volumes at the surface as well as pressure measurements at the pump (step 320). When an increase in the water cut is observed, the system is activated to separate water from hydrocarbons before inject the water down into formation.

A similar approach can be used to install and operate downhole separation systems in producing and dead wells. In both situations, workover involvement is needed to install the dual tubing completion and place the downhole separator with downhole pump.

In particular, well modifications are designed after a request from the reservoir to install the dual tubing completion and place the downhole separator with downhole pump. A new completion and the dual tubing with pipe collector are run in. If necessary, the old casing is retrieved. The designed path is drilled and cased before steps 316-320 of the method 300 are performed.

Figure 3:
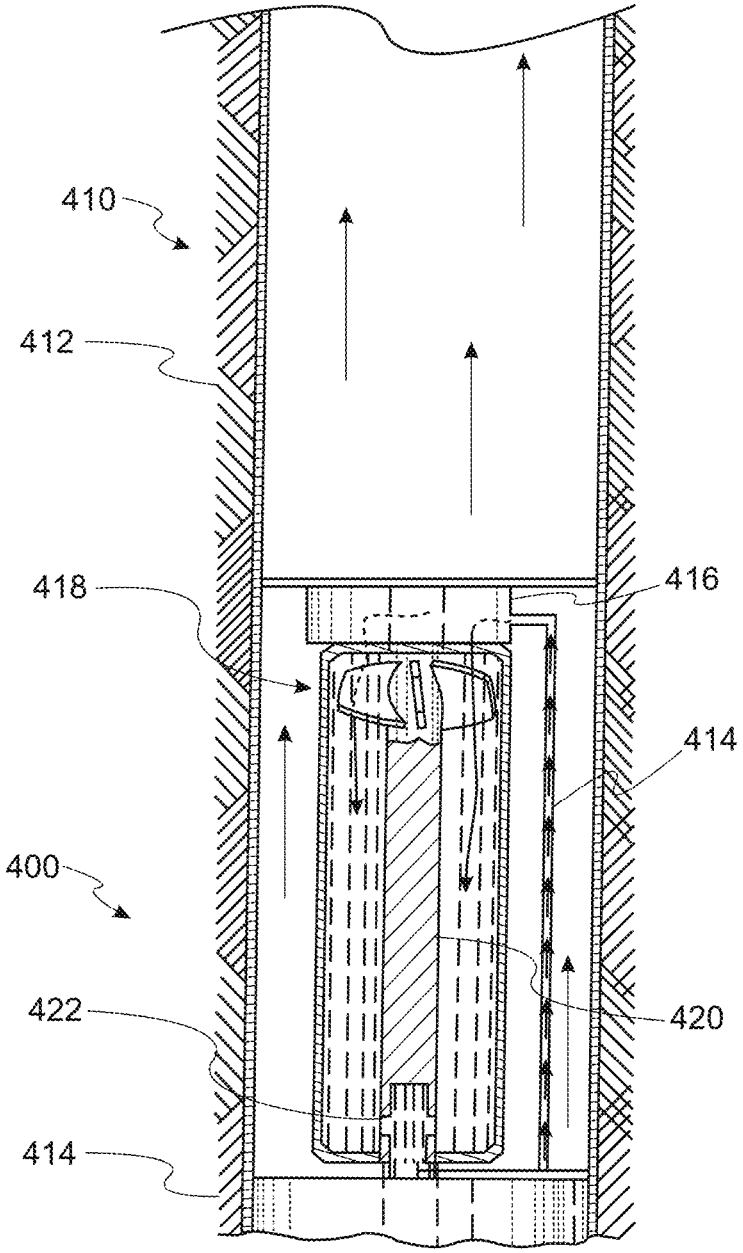
FIG. 3 is a partial cross-sectional view of an implementation of a downhole separation device.

FIG. 3 is a partial cross-sectional view of an implementation of a downhole separation system 400 installed in a well 410. The well 410 has a casing 412 that extends down to and beyond a liquid-gas separator 414 to a portion (not shown) of the well 410 that contains produced fluids with water and gas (e.g., wet gas). As previously discussed, the liquid/gas separator 414 (shown schematically in FIG. 1) may be any one of several known types of separators, such as those using gravity, shrouds, centrifugal or rotary gas separation, or gas-liquid cylindrical cyclonic, or in-line separation technology. The liquid-gas separator 414 discharges water to an intake 416 of a pump 418.

The pump 418 is operated by a drive motor (not shown) powered from the surface (e.g., by a power cable). The drive motor rotates a shaft 420 of the pump 418. Although the pump 418 is illustrated in a single stage format for illustration purposes, the blades are typically provided in multiple stages. The pump 418 discharges to a hollow portion 422 of shaft 420 which is connected to the water tubing (not shown). As previously discussed with reference to FIG. 1, the water tubing extends downhole to the water zone of the formation.

EXAMPLES

In an example implementation, systems and methods for downhole separation of water from hydrocarbons in a wellbore include a first seal limiting flow of fluids downhole in the wellbore and a second seal limiting flow of fluids uphole in the wellbore. A hydrocarbon separator is positioned to receive fluids present in the wellbore between the first seal and the second seal and discharge hydrocarbons into the wellbore uphole of the second seal. A liquid collection vessel receives water discharged by the hydrocarbon separator. A conduit extends downhole from the liquid collection vessel through the first seal and the second seal. A pump installed with the conduit is operable to pump fluids from liquid collection vessel downhole and out of the wellbore.

In an aspect combinable with the example implementation, the hydrocarbon separator includes a liquid-gas separator. In some cases, the hydrocarbon separator further comprises a water-oil separator.

In another aspect combinable with any of the previous aspects, the hydrocarbon separator includes a water-gas separator.

In another aspect combinable with any of the previous aspects, the hydrocarbon separator includes a water-oil separator.

In another aspect combinable with any of the previous aspects, a valve system operated based on water saturation is also included. In some cases, the valve system is configured to open when water saturation in the liquid collection vessel exceeds 98% and/or the valve system is configured to close when water saturation in the liquid collection vessel drops 95%.

In another aspect combinable with any of the previous aspects, a third seal installed at the bottom of the casing is also included. In some cases, the conduit extends past the third seal.

In another aspect combinable with any of the previous aspects, the casing is cemented around the separated water tubing below the second seal.

In another aspect combinable with any of the previous aspects, the pump is an inverted electrical submersible pump.

In another aspect combinable with any of the previous aspects, the first seal and the second seal include packers.

A number of embodiments of these systems and methods have been described. Nevertheless, it will be understood that various modifications may be made without departing from the scope of this disclosure. Accordingly, other embodiments are within the scope of the following claims.

What is claimed is:

1. A system for downhole separation of water from hydrocarbons in a wellbore, the system comprising:

a first seal disposed in the wellbore downhole of apertures extending through a casing of the wellbore, the first seal limiting flow of fluids downhole in the wellbore;

a second seal disposed in the wellbore uphole of the apertures extending through the casing of the wellbore, the second seal limiting flow of fluids uphole in the wellbore;

a hydrocarbon separator positioned to receive fluids present in the wellbore between the first seal and the second seal, the hydrocarbon separator discharging hydrocarbons into the wellbore uphole of the second seal;

a liquid collection vessel receiving a liquid-dominated stream including water discharged by the hydrocarbon separator;

a conduit extending downhole from the liquid collection vessel through the first seal and the second seal;

a valve system operated based on water saturation in the liquid collection vessel; and a pump installed with the conduit and operable to pump fluids from liquid collection vessel downhole and out of the wellbore.

2. The system of claim 1, wherein the hydrocarbon separator comprises a liquid-gas separator.

3. The system of claim 2, wherein the hydrocarbon separator further comprises a water-oil separator.

4. The system of claim 1, wherein the hydrocarbon separator comprises a water-gas separator.

5. The system of claim 1, wherein the hydrocarbon separator comprises a water-oil separator.

6. The system of claim 1, wherein the valve system is configured to open when water saturation in the liquid collection vessel exceeds 98%.

7. The system of claim 6, wherein the valve system is configured to close when water saturation in the liquid collection vessel drops 95%.

8. The system of claim 1, further comprising a third seal installed at the bottom of the casing.

9. The system of claim 8, wherein the conduit extends past the third seal.

10. The system of claim 1, wherein the pump is an inverted electrical submersible pump.

11. The system of claim 1, wherein the first seal and the second seal comprise packers.

12. A system for downhole separation of water from hydrocarbons in a wellbore, the system comprising:

a first seal disposed in the wellbore downhole of apertures extending through a casing of the wellbore, the first seal limiting flow of fluids downhole in the wellbore;

a second seal disposed in the wellbore uphole of the apertures extending through the casing of the wellbore, the second seal limiting flow of fluids uphole in the wellbore;

a liquid-gas separator positioned to receive fluids present in the wellbore between the first seal and the second seal, the liquid-gas separator discharging hydrocarbons into the wellbore uphole of the second seal;

a liquid collection vessel receiving water discharged by the hydrocarbon separator;

a conduit extending downhole from the liquid collection vessel through the first seal and the second seal;

a pump installed with the conduit and operable to pump fluids from liquid collection vessel downhole and out of the wellbore, and a valve system operated based on water saturation, the valve system controlling the pump.

13. The system of claim 12, wherein the liquid-gas separator comprises a water-gas separator.

14. The system of claim 12, wherein the liquid-gas separator comprises a water-oil separator.

15. The system of claim 12, wherein the valve system is configured to open when water saturation in the liquid collection vessel exceeds 98%.

16. The system of claim 15, wherein the valve system is configured to close when water saturation in the liquid collection vessel drops 95%.

17. The system of claim 12, further comprising a third seal installed at the bottom of the casing, wherein the conduit extends past the third seal.

18. The system of claim 12, wherein the pump is an inverted electrical submersible pump.

* * * * *